US006311362B1

(12) United States Patent
Arbogast

(10) Patent No.: US 6,311,362 B1
(45) Date of Patent: Nov. 6, 2001

(54) SCRAPER FOR REMOVING CHEWING GUM, GREASE, PAINT, AND WAX FROM CARPET

(76) Inventor: Gary W. Arbogast, 297 N. 200 West, Logan, UT (US) 84321-3805

( * ) Notice: Subject to any disclaimer, the term of this patent is extended or adjusted under 35 U.S.C. 154(b) by 0 days.

(21) Appl. No.: 09/190,631

(22) Filed: Nov. 12, 1998

(51) Int. Cl.[7] ..... A47L 13/02
(52) U.S. Cl. ..... 15/236.08; 3/169
(58) Field of Search ..... 30/169; 15/236.01, 15/236.05, 236.07, 236.08

(56) References Cited

U.S. PATENT DOCUMENTS

| | | | | |
|---|---|---|---|---|
| D. 156,638 | * | 12/1949 | Lifshutz | 30/169 |
| 440,558 | * | 11/1890 | Fromming | 30/169 |
| 711,423 | * | 10/1902 | Greene | 15/236.08 |
| 981,517 | * | 1/1911 | Andrews | 15/236.08 |
| 1,096,496 | * | 5/1914 | Dysko | 15/236.08 |
| 2,148,944 | * | 2/1939 | Helm | 15/236.08 |
| 2,492,606 | * | 12/1949 | West | 15/236.08 |
| 4,064,588 | * | 12/1977 | Cooper | 15/236.08 |
| 4,536,910 | * | 8/1985 | Clark | 15/236.01 |
| 5,309,598 | * | 5/1994 | Carpenter | 15/236.08 |
| 5,454,132 | * | 10/1995 | Neves | 15/236.08 |
| 5,713,097 | * | 2/1998 | Brown | 15/236.08 |
| 5,779,475 | * | 7/1998 | Patel | 15/236.08 |

FOREIGN PATENT DOCUMENTS

| | | | | |
|---|---|---|---|---|
| 3307831 | * | 9/1984 | (DE) | 15/236.08 |
| 966 | * | of 1873 | (GB) | 15/236.01 |

* cited by examiner

*Primary Examiner*—Randall E. Chin
(74) *Attorney, Agent, or Firm*—Mallinckrodt & Mallinckrodt; Brian R. Rayve

(57) ABSTRACT

A scraper for use with solvents and cleaners, particularly gel-type solvents which do not soak into carpet, to remove gum, grease, paint, and wax from carpeting. The scraper is preferably a single piece of plastic having an elongate handle portion which is held in hand generally parallel to the carpet and which handle curves downwardly ending in a working portion having a textured surface disposed generally parallel to the carpet. The textured surface preferably includes a plurality of transverse, forward-tipped teeth such that after application of the solvent to the gum, grease, paint, or wax, the scraper is moved in a forward, vertical, semi-circular motion such that the teeth engage the gum, grease, paint, or wax in a single direction parallel to the carpet and then lifted therefrom and moved backwards for a repeat stroke. The teeth act to agitate and work the gel into the gum, grease, paint, or wax, producing small waves of loosened material. The gel acts to prevent the gum, grease, paint, or wax from sticking to itself and to the scraper to aid in the removal by hand thereof.

2 Claims, 2 Drawing Sheets

SCRAPER FOR REMOVING CHEWING GUM, GREASE, PAINT, AND WAX FROM CARPET

BACKGROUND OF THE INVENTION

1. Field

Figure 4:
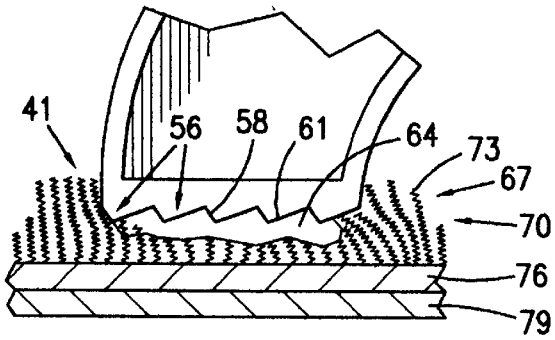

The invention is in the field of hand-held devices for use in conjunction with an appropriate solvent to remove chewing gum, grease, paint, and wax from the nap of carpeting by agitating the gum, grease, paint, or wax and the carpet nap to soak in the solvent.

2. State of the Art

The removal of chewing gum, grease, paint, and wax from carpet is a long-standing problem. Such gum, grease, paint, or wax is typically very sticky and gets tangled in the upper portion, or the nap of the carpet, without penetrating therethrough to the primary backing to which the nap is woven or stitched, nor to the secondary backing which is typically glued to the lower surface of such primary backing against the floor. Various devices have been used in the past to remove such substances from carpet. One such device designed primarily for removing gum from carpet is a so-called bone scraper which is an elongate, flattened device of about the size and configuration of a popsicle stick but slightly shorter in length and wider, the width thereof being tapered at one end to a point. The device is used in conjunction with a gum-dissolving solvent which is worked into the gum by means of the pointed end thereof poking and prodding the gum to mix the solvent therewith. The solvent prevents the gum from further sticking to itself, the carpet, and the device, such that the gum can be picked from the carpet in pieces rather than necessitating completely dissolving the gum. The device is only marginally effective in removing gum from carpet. An appropriate gel-type solvent can be used on the gum, grease, paint, or wax rather than the typical non-thickened solvents which have a water-like consistency. Such gels do not soak through the nap into the primary backing which could cause the glue laminating the primary and secondary backings together, such as those glues which are latex-based, to dissolve and thus delaminate the carpet. One such gel-type solvent for use with gum is a citrus peel-based solvent with a thixotropic thickening agent.

SUMMARY OF THE INVENTION

A scraper for use with solvents and cleaners, particularly gel-type solvents which do not soak into carpet, to remove gum, grease, paint, and wax from carpeting. The scraper comprises an elongate handle portion which in a working position is preferably held in hand generally parallel to the carpet. The scraper has a preferably downwardly disposed working portion integral therewith or otherwise connected thereto having a textured surface which in such position is generally parallel to the carpet. The textured surface can be any which can agitate the carpet, typically by means of surface projections thereon, preferably forward tilted, transverse teeth. The device is used by first applying the appropriate solvent to the gum, grease, paint, or wax, followed by moving the scraper in a thrusting motion against the surface of the gum, grease, paint, or wax and the carpet nap. The textured surface acts to agitate and work the solvent into the gum, grease, paint, or wax, preferably rolling over small portions of the surface thereof onto itself with the solvent preventing the gum, grease, paint, or wax from sticking to itself, the carpet nap, and to the scraper to aid in the removal by hand thereof. The scraper can also be used with an appropriate spot remover solvent to remove stains from carpet and cloth items.

THE DRAWINGS

Figure 1:
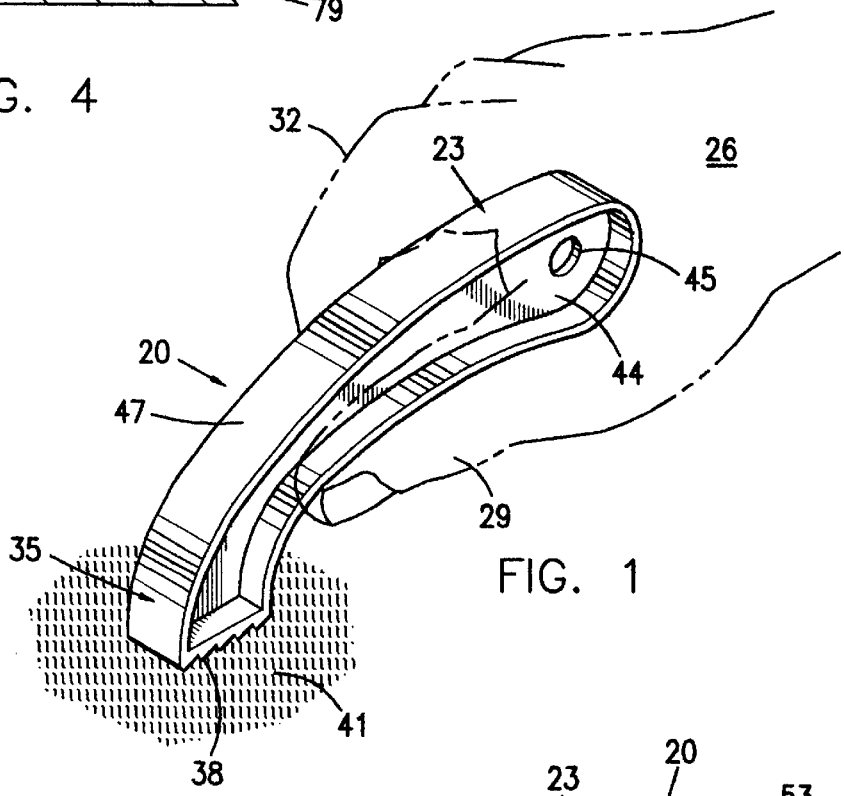
Figure 3:
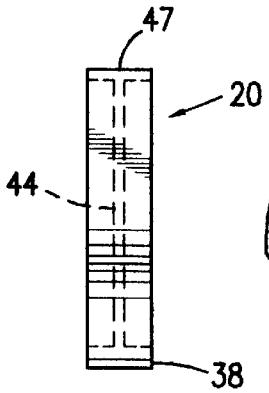
Figure 2:
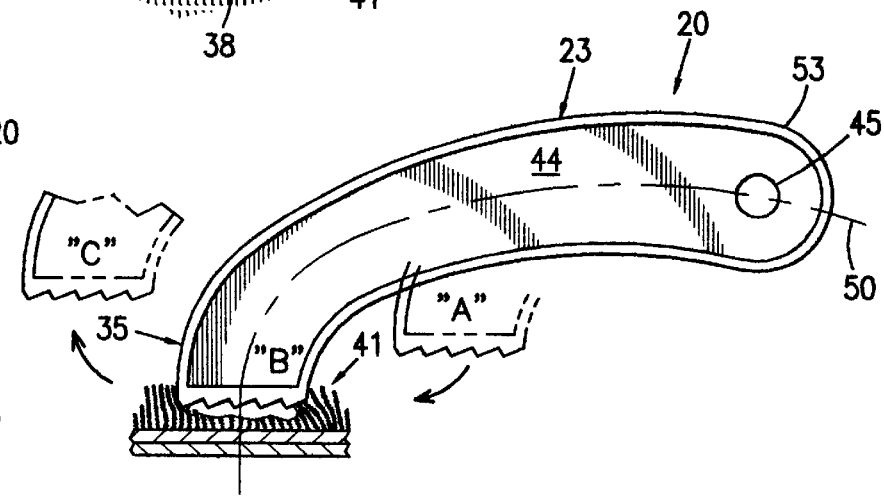
Figure 5:
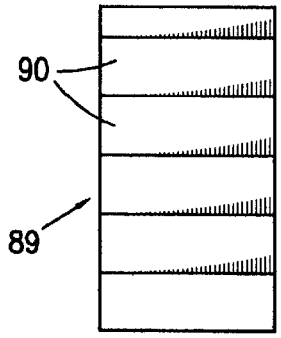
Figure 5A:
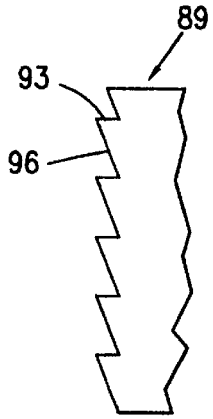
Figure 6:
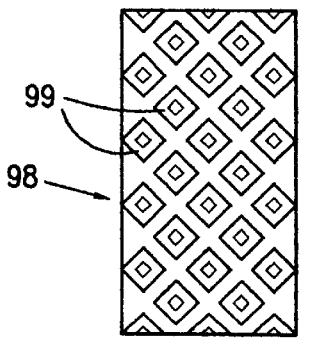
Figure 6A:
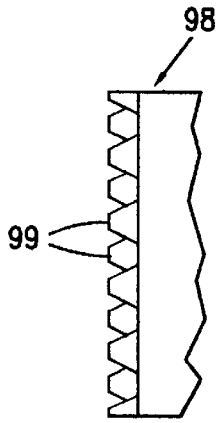
Figure 7:
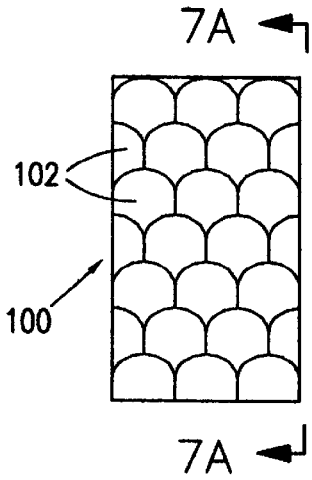
Figure 7A:
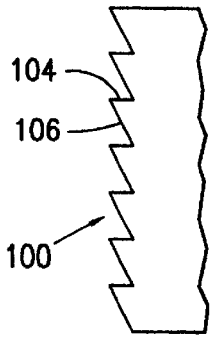
Figure 8:
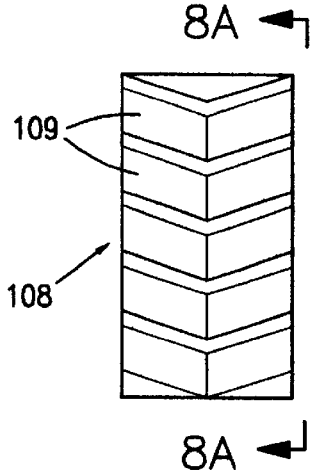
Figure 8A:
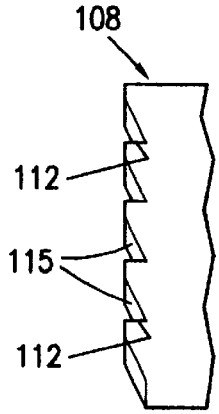
Figure 9:
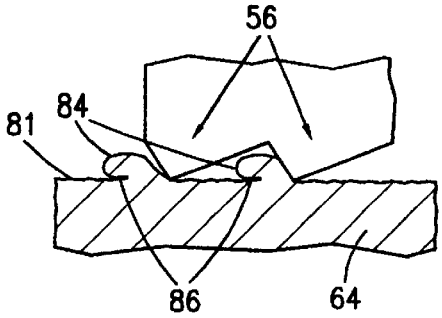
Figure 10:
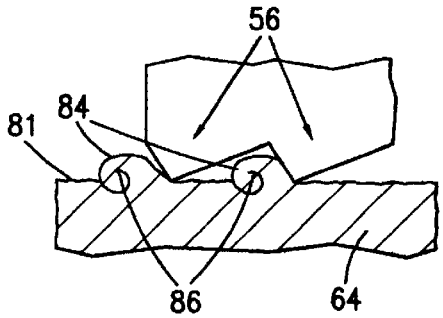

The best mode presently contemplated for carrying out the invention is illustrated in the accompanying drawings, in which:

FIG. 1 is a perspective view of a first embodiment the invention as held in hand and pressed against the nap of a carpet;

FIG. 2, a side elevational view of such first embodiment with arrows indicating the stroking motion of the invention in use;

FIG. 3, a front elevational view of such first embodiment showing the I-beam construction thereof;

FIG. 4, an enlarged fragmentary view corresponding to FIG. 2 showing such first embodiment including the first version textured surface as applied to the nap of a carpet;

FIG. 5, an enlarged fragmentary view of a second version textured surface;

FIG. 5A, an enlarged fragmentary sectional view taken on the line 5A—5A of FIG. 5 showing details of such second version textured surface;

FIG. 6, an enlarged fragmentary view of a third version textured surface;

FIG. 6A, an enlarged fragmentary sectional view taken on the line 6A—6A of FIG. 6 showing details of such third version textured surface;

FIG. 7, an enlarged fragmentary view of a fourth version textured surface;

FIG. 7A, an enlarged fragmentary sectional view taken on the line 7A—7A of FIG. 7 showing details of such fourth version textured surface;

FIG. 8, a fragmentary view of a fifth version textured surface;

FIG. 8A, an enlarged fragmentary sectional view taken on the line 8A—8A of FIG. 8 showing details of such fifth version textured surface;

FIG. 9, a fragmentary view showing the folding-over of the gum by the transverse teeth of the first version textured surface;

FIG. 10, a fragmentary view corresponding to FIG. 9, but wherein the rolling process is further developed by continued forward motion of the transverse teeth.

DETAILED DESCRIPTION OF THE ILLUSTRATED EMBODIMENTS

Referring to FIGS. 1, 2, and 3, therein is shown a preferred embodiment scraper 20 which includes an elongate, curved handle portion 23 of sufficient length to accommodate gripping by a user's hand 26 such as between the thumb 29 and at least one finger 32. Scraper 20 further includes an integral working portion 35 having a first version textured surface 38 which is used to engage the surface 41 from which the chewing gum, grease, paint, or wax is to be removed. Handle portion 23 and working portion 35 have an I-beam construction for light weight and ease of gripping, having a common central web 44, and a common peripheral flange 47 which extends completely around central web 44, and which may include a hole 45 for hanging scraper 20 in storage. Handle portion 23 and working portion 35 are curved such that the centerline thereof 50 bends between about eighty degrees and one hundred degrees such that textured surface 38 is oriented about ninety degrees from end 53 of handle 23. This orientation between handle 23 and textured surface 38 facilitates horizontal stroking as will be explained subsequently. Scraper 20 is preferably a single piece of any of a number of commonly available thermoform or thermoset plastics, made such as by injection molding. Textured surface 38 includes a plurality of projections, preferably transverse parallel teeth 56 each of which is tilted forward so as to have a small front, or leading surface 58 and a larger back, or trailing surface 61.

In FIGS. 1, 2, and 4 is illustrated how scraper 20 is used to remove chewing gum, grease, paint, and wax 64 from a surface comprising carpet 67, including a carpet nap 70 made of a plurality of separate yarns 73 woven to an upper, or primary cloth backing 76 which is adhesively connected to a lower, or secondary cloth backing 79. The adhesive is typically latex-based which can be dissolved by standard solvents used to dissolve chewing gum, grease, paint, or wax. The scraper 20 is held in hand by gripping handle portion 23 and holding scraper 20 as in position "A". Scraper 20 is moved forward through position "B" wherein teeth 56 engage gum, grease, or wax 64 and nap 70 so as to agitate and allow the solvent (not shown) to mix with the gum, grease, paint, or wax. After a horizontal movement, scraper 20 is lifted such as to position "C" out of contact with the gum, grease, paint, or wax.

The scraper preferably works as shown in FIGS. 9 and 10 wherein the surface 81 of gum, grease, paint, or wax 64, which is covered with solvent (not shown), is scraped by teeth 56 so as to form waves 84 each of which form a space 86 which fills with solvent. As teeth 56 continue to move forward, the waves 84 roll over and space 86 compresses so as to contain only a thin layer of solvent which prevents each of waves 84 from sticking to itself nor to gum, grease, paint, or wax 64. When waves 84 become large enough by continued rolling over on themselves, they can be easily removed from gum, grease, paint, or wax 64 by means of one's fingers. The size of waves 84 can be adjusted by the amount of downward force applied to textured surface 38. Likewise, the harder the gum, grease, paint, or wax 64, the more downward force which may be necessary to produce waves 84 of a given size.

While the embodiment of the invention shown is preferred, there can be many variations thereof keeping within the scope of the same inventive concept. The textured surface 38 can be of a wide variety of patterns, such as random pattern as a flattened knurled pattern (not shown), or such as in a sandpaper texture (not shown), or set patterns such as second version textured surface 89 having projections therefrom being ratchet-type teeth 90 each having a forward surface 93 generally perpendicular to the carpet surface 41 and a forward-angled rear surface 96 (FIGS. 5 and 5A), third version textured surface 98 having frusto-pyramidal projections 99 (FIGS. 6 and 6A), fourth version textured surface 100 having fish-scale projections 102 each having an arcuate front surface 104 and rear surface 106 (FIGS. 7 and 7A), and fifth version textured surface 108 having chevron projections 109 each including a front surface 112 and a rear surface 115 (FIGS. 8 and 8A). Other projections include, but are not limited to vertical cylinders, triangles, frusto-triangles, squares, rectangles, or most any shape including combinations of two or more thereof on the same textured surface.

Other variations are possible including but not limited to the textured surface being a removable or interchangeable piece from the working portion so as to allow the use of different textured surfaces for different applications using the same handle portion. The scraper can be made with the handle portion a separate piece from the working portion, and/or with each of handle portions as one or more individual pieces. All of the component parts can be made from a wide variety of materials including thermoform and thermoset plastics, aluminum (especially if anodized to prevent corrosion), carbon steels (painted, plated, or otherwise protected from corrosion), and stainless steel. The scraper can be angular rather than smoothly curved as shown, the scraper can have a solid round, oval, square, or other cross-section rather than the open I-beam cross-section. The angle of the centerline between the handle portion and the textured surface can be any desired, for example, such as between minus one-hundred-twenty degrees (reversed) to zero degrees (straight upright) to plus one-hundred-twenty degrees, or even angled in either lateral direction, depending on the forward or reverse or sideways direction of movement of scraper desired and the desired position of the user's hand.

Whereas this invention is here illustrated and described with reference to embodiments thereof presently contemplated as the best mode of carrying out such invention in actual practice, it is to be understood that various changes may be made in adapting the invention to different embodiments without departing from the broader inventive concepts disclosed herein and comprehended by the claims that follow.

I claim:

1. A hand-operable scraping device made of plastic for scraping and agitating the nap of carpet to remove gum, grease, paint, and wax therefrom, comprising a handle portion and a working portion both being of a generally I-beam cross-section with said handle portion being curved into said working portion, said handle portion being of sufficient length for holding the device in hand and said working portion having a textured surface which is angled relative to the handle portion, the textured surface and a longitudinal axis of the handle portion being generally parallel, and said textured surface comprising a plurality of generally transverse teeth which are tilted forward for engaging the nap.

2. A scraping device according to claim 1, wherein the handle portion has a transverse hanging hole therethrough.

* * * * *